US006365863B1

(12) United States Patent
Marin et al.

(10) Patent No.: US 6,365,863 B1
(45) Date of Patent: Apr. 2, 2002

(54) HIGH VOLTAGE CIRCUIT-BREAKER WITH A COUNTER-CONTACT WHICH CAN BE ACTUATED

(75) Inventors: Heiner Marin, Berlin; Volker Lehmann, Treuenbrietzen; Hold Dienemann; Thomas Chyla, both of Berlin, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/486,508

(22) PCT Filed: Aug. 28, 1998

(86) PCT No.: PCT/DE98/02604

§ 371 Date: Jun. 1, 2000

§ 102(e) Date: Jun. 1, 2000

(87) PCT Pub. No.: WO99/12176

PCT Pub. Date: Mar. 11, 1999

(30) Foreign Application Priority Data

Aug. 29, 1997 (DE) ..... 197 38 697

(51) Int. Cl.[7] ..... H01H 33/70

(52) U.S. Cl. ..... 218/43; 218/78; 218/84; 218/154

(58) Field of Search ..... 218/59–64, 72, 218/78, 84, 120, 154, 43–50

(56) References Cited

U.S. PATENT DOCUMENTS 4,211,902 A * 7/1980 Tsuchida ..... 218/154
5,578,806 A * 11/1996 Hofbauer et al. ..... 218/59

FOREIGN PATENT DOCUMENTS

| | | |
|---|---|---|
| EP | 0 025 833 | 4/1981 |
| EP | 0 313 813 | 5/1989 |
| FR | 2 491 675 | 4/1982 |

* cited by examiner

*Primary Examiner*—Lincoln Donovan
(74) *Attorney, Agent, or Firm*—Kenyon & Kenyon

(57) ABSTRACT

In a high voltage circuit breaker having a contact system comprising a contact driven by a switch mechanism and a counter-contact opposite the contact and driven by an auxiliary gear, the parallel current path leading over the auxiliary gear is interrupted by using an insulation part between the counter-contact and a second terminal of the high voltage circuit breaker.

10 Claims, 3 Drawing Sheets

HIGH VOLTAGE CIRCUIT-BREAKER WITH A COUNTER-CONTACT WHICH CAN BE ACTUATED

FIELD OF THE INVENTION

The present invention relates to a high voltage circuit breaker having a contact system, a contact driven by a switch mechanism, and a counter-contact opposite the contact and driven by a transmission element. An auxiliary gear is formed by a multiple transmission elements. The contact is electrically connected to a first electric terminal of the high voltage circuit breaker. The counter-contact is electrically connected to a second electric terminal of the high voltage circuit breaker via a current path.

BACKGROUND INFORMATION

Such a high voltage circuit breaker is described in, for example, European Patent No. 0 313 813. This patent describes a contact driven by a switch mechanism, where a stud-shaped counter-contact can also be driven to increase the contact separation rate in a shutdown operation in particular. The motion of the driven contact is transmitted to the counter-contact by motion transmission elements or an auxiliary gear, driving the counter-contact in the direction of motion opposite that of the contact.

French Patent 2 491 675 also describes a high voltage circuit breaker where a driven contact and a counter-contact driven in the opposite direction by an auxiliary gear and by motion transmission elements are provided.

European Patent Application 0 25 833 A1 also describes a high voltage circuit breaker where a contact and a counter-contact are linked by a gear and can be driven in opposite directions in the event of shutdown.

SUMMARY

An object of the present invention is to provide a high voltage circuit breaker of the type defined in the preamble such that its lifetime is lengthened in comparison with that of conventional switches.

This object is achieved according to the present invention by the fact that a parallel current path which is electrically parallel to the current path and leads from the counter-contact to the second terminal of the high voltage circuit breaker by way of the transmission elements is interrupted by an insulation area. At least one of the transmission elements may be designed so that it is electrically insulating in order to interrupt a parallel current path formed in parallel to the main current path between the counter-contact and the second terminal of the high voltage circuit breaker.

Conventional high voltage circuit breakers have in common the fact that the counter-contact is driven by an auxiliary gear and transmission elements which are connected at least in part to stationary parts of the switch, e.g., for bearing purposes. For example, gearwheels or levers must be pivotingly mounted at a fixed point.

This fails to take into account the problem that a parallel current path is thus created from the counter-contact to the second terminal of the circuit breaker by way of the auxiliary gear or the motion transmission elements; this current path is parallel to the main current path leading from the counter-contact to the second terminal usually by way of slide contacts.

The drive mechanism for the counter-contact is destroyed or at least damaged after a few switching cycles due to the electric load, because motion transmission elements and auxiliary gear are not normally designed to carry high currents such as those occurring in the event of a short circuit, for example.

Due to the method of achieving the object of the present invention, current flow outside the main current path is completely prevented, so that mechanical parts cannot be damaged due to such a current flow.

Furthermore, this also prevents the effects of magnetic forces occurring due to parallel current-carrying current paths which can have a negative effect on the contact pressure in the case of slide contacts, for example, due to lifting of the contact fingers.

An advantageous embodiment of the present invention provides for the end of the counter-contact facing away from the contact to be made of insulating material in the area of the point of action of the transmission elements.

Thus, the auxiliary current path from the counter-contact over the auxiliary gear to the second terminal of the circuit breaker is interrupted at the point of action of the transmission elements on the counter-contact.

Another advantageous embodiment of the present invention provides for at least one bearing or one shaft of the auxiliary gear to be made at least partially of an insulating material.

Additional advantageous embodiments of the present invention provide for a stud of the auxiliary gear sliding in a sliding guide to be made at least in part of insulating material or a sliding guide of the auxiliary gear to be made of an insulating material.

DETAILED DESCRIPTION

Figure 1:
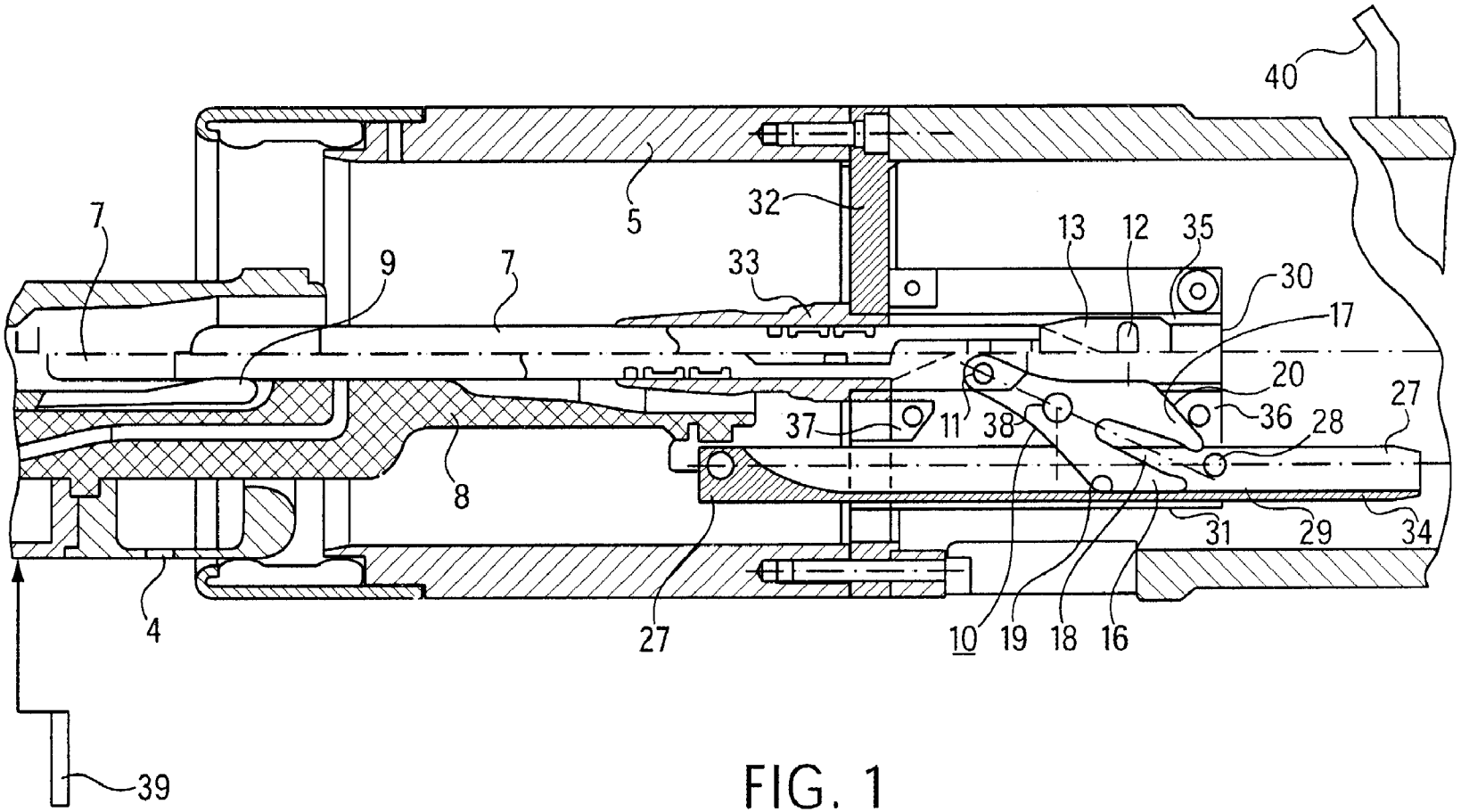
FIG. 1 shows the pairing of an auxiliary gear with a fixed continuous current contact of a high voltage circuit breaker, namely in one end position.
Figure 2:
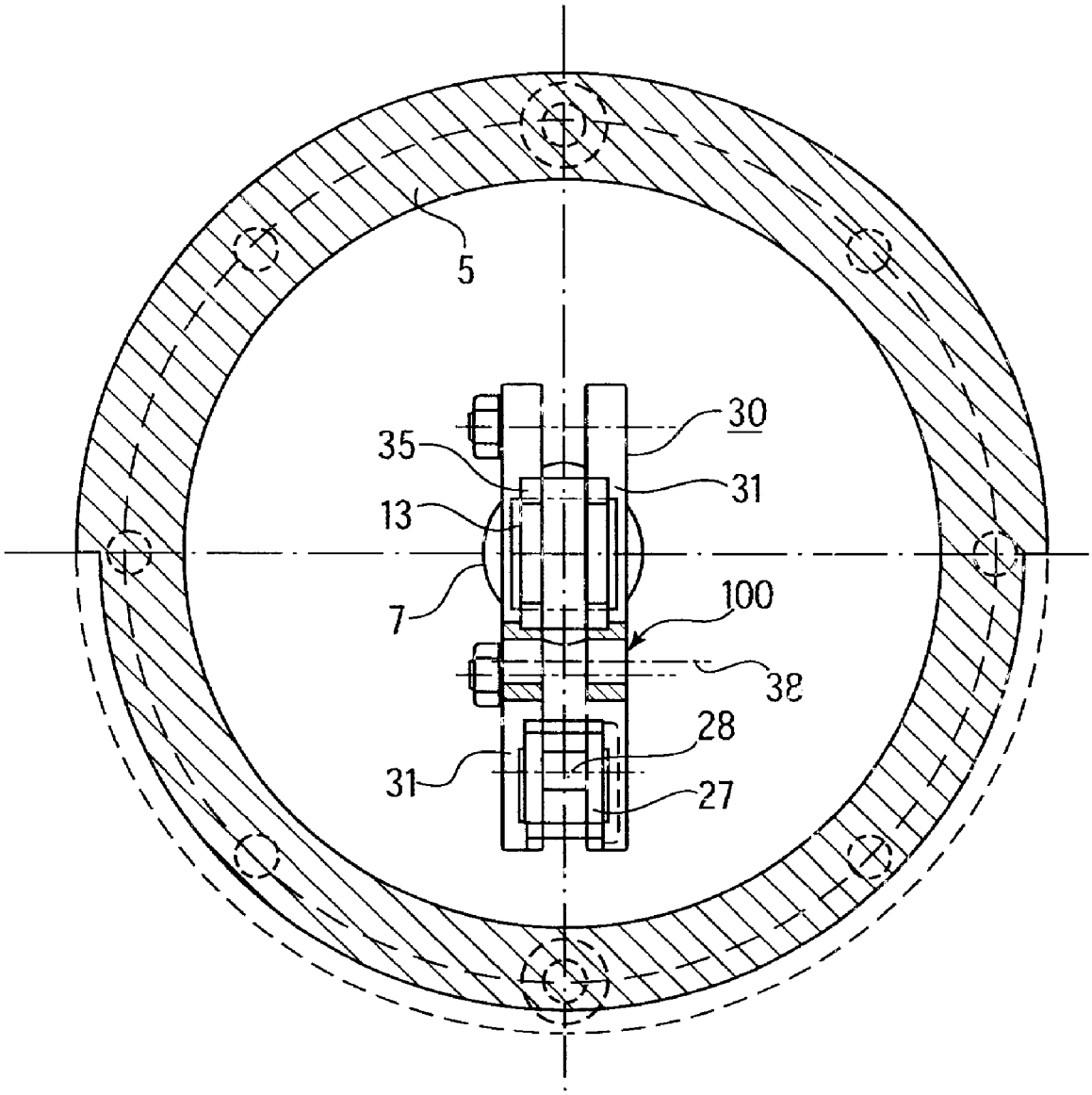
FIG. 2 shows a cross section through an auxiliary gear.

Following FIG. 2 of European Patent 0 383 813 B1, FIG. 1 shows details of the fixed continuous current contact 5 of a high voltage circuit breaker into which an axially driven continuous current contact 4 having insulation nozzle 8 attached to it and axially driven contact 9 projects from the left. The lower half of the figure shows the closed position of driven continuous current contact 4 and the upper half shows the position of insulation nozzle 8 in the open position. In the closed position, insulation nozzle 8 also surrounds counter-contact 7 which is driven in the opposite direction. In this position, first terminal 39 and second terminal 40 of the switch are conductively connected. Terminals 39, 40 are shown symbolically in FIG. 1. Rod-like transmission element 27 is attached to insulation nozzle 8; it is designed here not as a gear rack but instead as a coupling rod and, to drive an auxiliary gear, it has a journal 28 arranged across the direction of thrust of coupling rod 27 having a U-shaped cross section. The coupling rod may also have an L-shaped or T-shaped cross section, with one part of the cross section forming a slideway to guide the coupling rod. In this embodiment, bottom 34 of the U-shaped cross section forms the slideway.

Unlike the conventional design, according to FIG. 2, coupling rod 27 is guided in two bearing cheeks 31 forming part of a casing 30. This casing is attached to a contact bridge 32 which is attached to fixed continuous current contact 5 and carries stationary part 33 of a tubular slide contact in which oppositely driven counter-contact 7 is contacted by way of contact blades. Counter-contact 7 has a flat head 13 on the end facing away from the arc gap, head being guided in two slideways 35 of casing 30 formed by bearing cheeks 31. Flat head 13 has an elongated hole 12 running vertically to coupling rod 27.

A two-armed control lever 10 with a fork at one end and a journal 11 at the other end is mounted on a shaft 38 running in casing 30 vertically to the plane of the drawing. Journal 11 engages in elongated hole 12 on head 13. The fork end has two prongs 16 and 17 forming a mouth-like opening 18 in which journal 28 of coupling rod 27 can engage. Two prongs 16 and 17 are provided on the outside with contact faces 19 and 20, respectively, with which control lever 10 comes to rest on bottom 34 of U-shaped cross-sectional profile of coupling rod 27, depending on the position of the control lever. Stops 36 and 37 in casing 30 guarantee that control lever 10 will remain in the respective stop position. The two stop positions are end positions between which control lever 10 moves under the influence of journal 28. Coupling rod 27 in bottom 34 of U-shaped cross section has an elongated slot 29 so that the fork end can execute a rotational motion about axis 38.

For example, head 13 may be made of an insulating material, e.g., fiberglass reinforced plastic to interrupt the current path from this end of counter-contact 7 over cheeks 31 and shaft 38 to casing 30 and to contact bridge 32. For this purpose, shaft 38 and/or its bearing 100 or journal 28 may also be made of an insulating material.

Journal 28, bearing cheeks 31 and control lever 10 are, as transmission elements, parts of the auxiliary gear converting the driving motion of driven contact 9 into an opposite driving motion of counter-contact 7.

Figure 3:
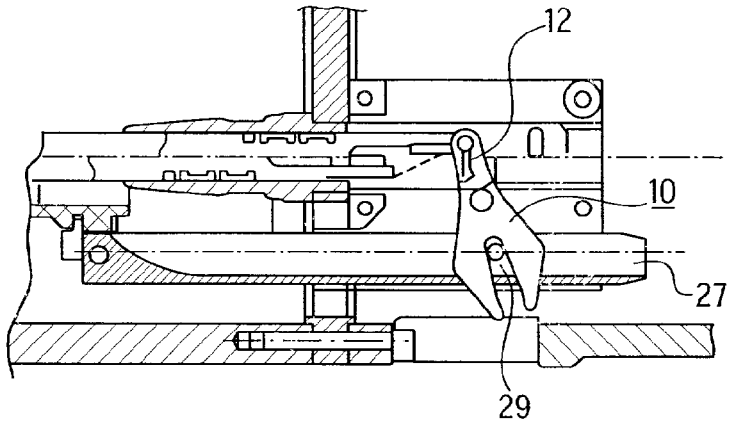
FIGS. 3 through 5 show an auxiliary gear in two intermediate positions and in the other end position.
Figure 4:
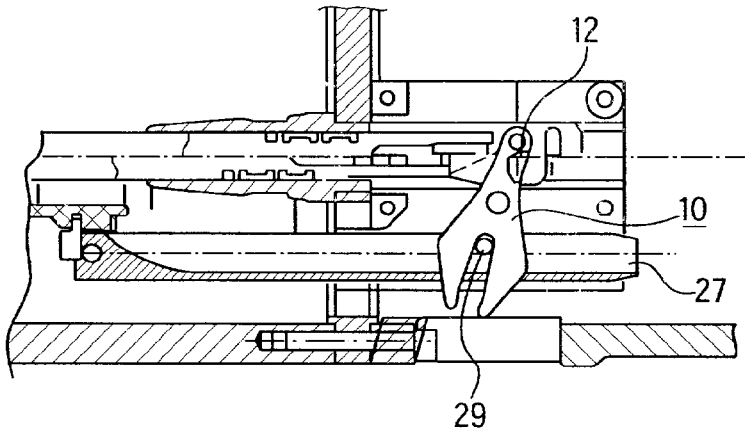
Figure 5:
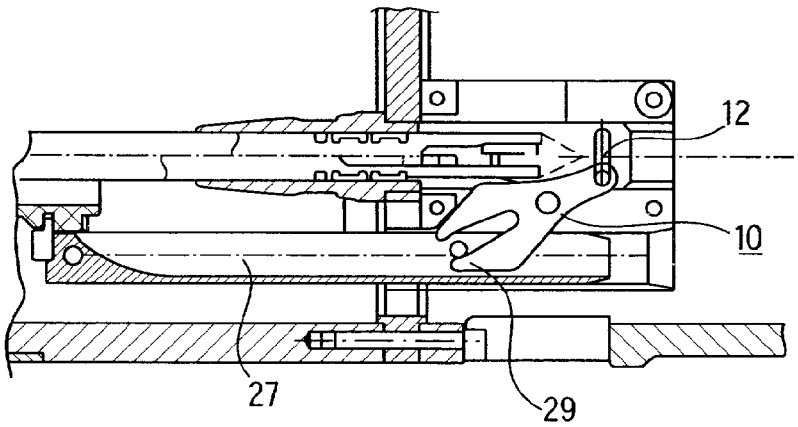

In a breaking motion, coupling rod 27 and thus journal 28 pass continuously through various intermediate positions, starting from the position illustrated in FIG. 1; FIGS. 2 and 3 illustrate the positions assumed by head 13 and thus also a respective driven counter-contact 7 shortly before and shortly after reaching maximum speed; FIG. 5 shows the other end position of control lever 10. Following the position shown in FIG. 5, the coupling rod may move even further to the right without control lever 10 changing its position.

What is claimed is:

1. A high voltage circuit breaker, comprising:

a contact system including a contact driven by a switch mechanism and a counter-contact opposite the contact;

transmission elements driving the contact system;

an auxiliary gear formed by a plurality of the transmission elements;

a first electric terminal, the contact being electrically connected to the first electric terminal;

a second electric terminal, the counter-contact being electrically connected to the second electric terminal by a main current path; and an area of insulation that prevents formation of a parallel current path, leading from the counter-contact via the transmission elements to the second terminal, electrically in parallel to the main current path, the parallel current path being interrupted by the area of insulation.

2. A high voltage circuit breaker, comprising:

a contact system including a contact driven by a switch mechanism and a counter-contact opposite the contact;

transmission elements driving the contact system, and least one of the transmission elements being electrically insulating;

an auxiliary gear formed by a plurality of the transmission elements;

a first electric terminal, the contact being electrically connected to the first terminal; and a second electric terminal, the counter-contact being electrically connected to the second electric terminal by a main current path, the at least one of the transmission elements preventing formation of a current path parallel to the main current path between the counter-contact and the second terminal.

3. The high voltage circuit breaker according to claim 1, wherein an end of the counter-contact facing away from the contact is made of an insulating material in an area of a point of action of the transmission elements.

4. The high voltage circuit breaker according to claim 2, wherein an end of the counter-contact facing away from the contact is made of an insulating material in an area of a point of action of the transmission elements.

5. The high voltage circuit breaker according to claim 1, wherein an at least one bearing or shaft of the auxiliary gear is made at least in part of an insulating material.

6. The high voltage circuit breaker according to claim 2, wherein an at least one bearing or shaft of the auxiliary gear is made at least in part of an insulating material.

7. The high voltage circuit breaker according to claim 1, wherein a journal of the auxiliary gear sliding in a slideway is made at least in part of insulating material.

8. The high voltage circuit breaker according to claim 2, wherein a journal of the auxiliary gear sliding in a slideway is made at least in part of insulating material.

9. The high voltage circuit beaker according to claim 1, wherein a slideway of the auxiliary gear is made of an insulating material.

10. The high voltage circuit breaker according to claim 2, wherein a slideway of the auxiliary gear is made of an insulating material.

* * * * *